US008844259B2

(12) United States Patent
Weeks et al.

(10) Patent No.: US 8,844,259 B2
(45) Date of Patent: Sep. 30, 2014

(54) FLASHBACK PROTECTOR

(75) Inventors: Simon A. Weeks, Ashby-de-la-Zouch (GB); Christopher G. Bright, Nottingham (GB)

(73) Assignee: Rolls-Royce PLC, London (GB)

( * ) Notice: Subject to any disclaimer, the term of this patent is extended or adjusted under 35 U.S.C. 154(b) by 718 days.

(21) Appl. No.: 13/181,061

(22) Filed: Jul. 12, 2011

(65) Prior Publication Data

US 2012/0023890 A1 Feb. 2, 2012

(30) Foreign Application Priority Data

Jul. 28, 2010 (GB) ..... 1012630.8

(51) Int. Cl.
*F23D 14/82* (2006.01)
*A62C 4/02* (2006.01)
*F23C 99/00* (2006.01)

(52) U.S. Cl.
CPC . *A62C 4/02* (2013.01); *F23D 14/82* (2013.01); *F23C 99/001* (2013.01)
USPC ..... 60/39.11; 431/346

(58) Field of Classification Search
USPC ..... 60/39.11, 39.091, 779, 223; 431/346, 431/22, 23
See application file for complete search history.

(56) References Cited

FOREIGN PATENT DOCUMENTS

SU 631162 A1 11/1978
SU 895448 A1 1/1982

OTHER PUBLICATIONS

Rietjens, "The Future for MHD Power Generation", Phys. Technol., 1979, pp. 216-221, vol. 10, The Institute of Physics, Great Britian.
P. C. Stangeby, "A Review of the Status of MHD Power Generation Technology Including Suggestions for A Canadian MHD Research Program," Institute for Aerospace Studies, Nov. 1974, UTIAS Review No. 39, University of Toronto.
http://en.Wikipedia.org/wikiMHD_generator, "MHD Generator," Wikipedia, Jun. 8, 2011, pp. 1-8.
British Search Report issued in British Application No. GB1012630.8 dated Oct. 8, 2010.

*Primary Examiner* — Andrew Nguyen
(74) *Attorney, Agent, or Firm* — Oliff PLC

(57) ABSTRACT

The present invention relates to a flashback protector (1) for limiting the propagation of a flame towards a fuel supply. The flashback protector comprises a downstream side (34) and an upstream side (32) defining a flow path between them. A magnetic-field generator (10, 20) is arranged to generate a magnetic field (40) across the flow path such that when a flashback occurs fluid flows in the flow path towards the fuel supply through the magnetic field (40). This causes a flow of current (50) to be induced in the fluid. This results in a force being generated on the fluid away from the fuel supply, preventing the flashback from reaching the fuel supply and causing an explosion.

13 Claims, 10 Drawing Sheets

FLASHBACK PROTECTOR

Figure 1:
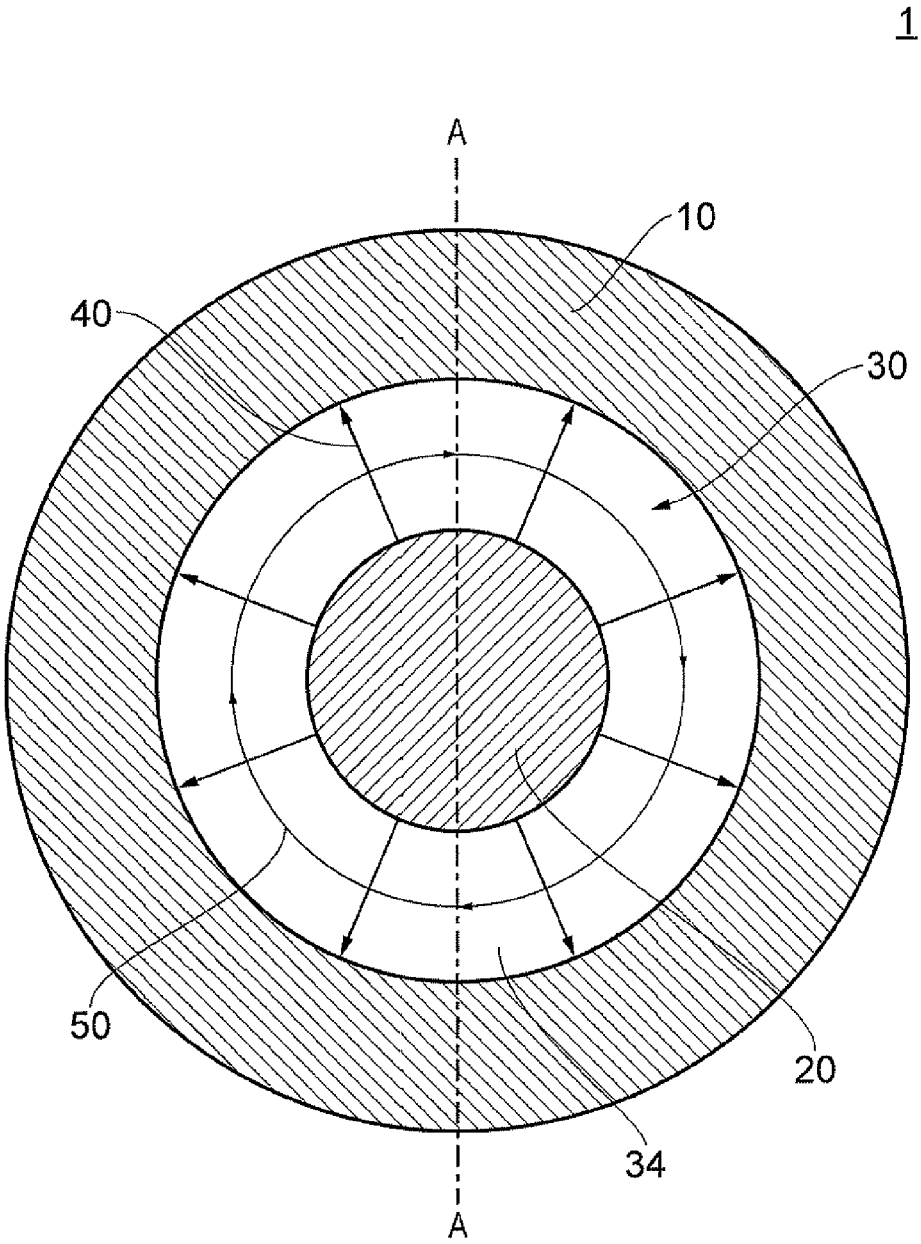

The invention relates to a flashback protector, and particularly, although not exclusively, to a magnetic flashback protector for a gas turbine engine.

A gas turbine engine comprises a compressor, a combustion chamber and a turbine. The compressor draws in air and pressurises it. This pressurised air is then fed to the combustion chamber where it is combusted with fuel. This causes the temperature and volume of the air to increase. The high-pressure, high-temperature air then expands through the turbine, thereby generating energy.

In the combustion chamber a flame is generated by the combustion of fuel supplied by a fuel-supply line from a fuel tank. It is rare, but possible, for flashback to occur. A flashback is when a flame travels down the fuel-supply line towards the fuel tank. This is obviously dangerous since if the flame reaches the fuel tank an explosion will occur. It is therefore known to use a safety device known as a flashback arrestor to prevent this.

A flashback arrestor is installed in the fuel-supply line between the area of combustion and the fuel tank and is arranged to prevent the flame propagating towards the fuel tank in the event of a flashback. Flashback arrestors can be broadly classified into two types according to the method of operation, these two types being known as active and passive.

One type of active flashback arrestor comprises a temperature-triggered valve located in the fuel-supply line. When a flashback occurs and the hot combustion gases and flame travel towards the fuel tank, the temperature in the region of the valve increases and causes the valve to shut. This prevents the flame from reaching the fuel tank causing an explosion. Active flashback arrestors are suitable for some circumstances but require maintenance since they have moving mechanical parts.

A known type of passive flashback arrestor comprises a metal or ceramic which absorbs heat from a flashback, thus preventing it from propagating towards the fuel tank. However, it is possible for a flame to become stable at the downstream face of the arrestor. This causes the arrestor to be heated. If the arrestor is sufficiently heated the upstream face of the arrestor becomes hot enough to ignite the upstream fuel. This allows the flashback to propagate towards the fuel tank. This is obviously undesirable.

Wet flashback arrestors also exist. These work by forcing the combustion gasses and flame of a flashback through a non-flammable liquid such as water. This works by extinguishing the flame before it reaches the fuel tank.

Prior art flashback arrestors are suitable for some applications. However, they may not be capable of arresting a very hot and violent flashback. They also inevitably place an undesirably large obstruction in the fuel-supply line which causes the fuel flow path to be restricted, thus impending fuel flow. The restricted flow path through the flashback arrestor can also result in the arrestor becoming clogged with gas-borne particles.

The present invention has been derived with these problems in mind.

It is therefore desirable to provide a flashback arrestor that requires little maintenance and that reliably stops a flashback.

According to a first aspect of the present invention there is provided a flashback protector for limiting the propagation of a flame towards a fuel supply, comprising: a downstream side and an upstream side defining a flow path between them; and a magnetic-field generator arranged to generate a magnetic field across the flow path; wherein when in use and a flashback occurs fluid flows in the flow path towards the fuel supply through the magnetic field, which then induces a flow of current in the fluid, thereby generating a force on the fluid in a direction away from the fuel supply. The force prevents the flashback from reaching the fuel supply and therefore prevents an explosion.

Preferably the magnetic-field generator comprises a first pole piece having a cavity within which a second pole piece is located in such a way that an opening is formed between the first and second pole pieces which in use provides the flow path for the fluid and across which the magnetic field is generated, wherein the flow path is in the form of a closed loop in a plane perpendicular to the flow direction such that in use the induced current can flow entirely within the fluid. Because the current flows entirely within the fluid it is not necessary to provide electrodes which would be susceptible to erosion and would need to be replaced periodically. The flow path may be generally annular in a plane perpendicular to the flow direction.

In one embodiment the magnetic-field generator comprises first and second electromagnets, each including a pole piece and a winding. This allows the strength of the magnetic field to be readily controlled.

The magnetic-field generator may comprises first and second permanent magnets. These require no maintenance and therefore may be preferred in some arrangements.

The magnetic-field generator may be arranged to generate a magnetic field that is stronger at a downstream side than an upstream side. This induces a current, and therefore a flashback opposing force, in the fluid at the downstream side.

The invention is also concerned with a gas turbine engine comprising a flashback protector according to any statement herein.

According to a second aspect of the present invention there is provided a method of limiting the propagation of a flame towards a fuel supply, comprising: generating a magnetic field across a flow path defined between a downstream side and an upstream side such that when a flashback occurs fluid flows towards the fuel supply through the magnetic field, which then induces a flow of current in the fluid, thereby generating a force on the fluid in a direction away from the fuel supply.

The fluid may flow in a closed loop in a plane perpendicular to the flow direction so that in use the induced current flows entirely within the fluid. The closed loop may be generally annular.

The magnetic field may be generated by electromagnets and/or permanent magnets. The magnetic field may be stronger at a downstream side than an upstream side.

The invention may comprise any combination of the features and/or limitations referred to herein, except combinations of such features as are mutually exclusive.

Figure 2:
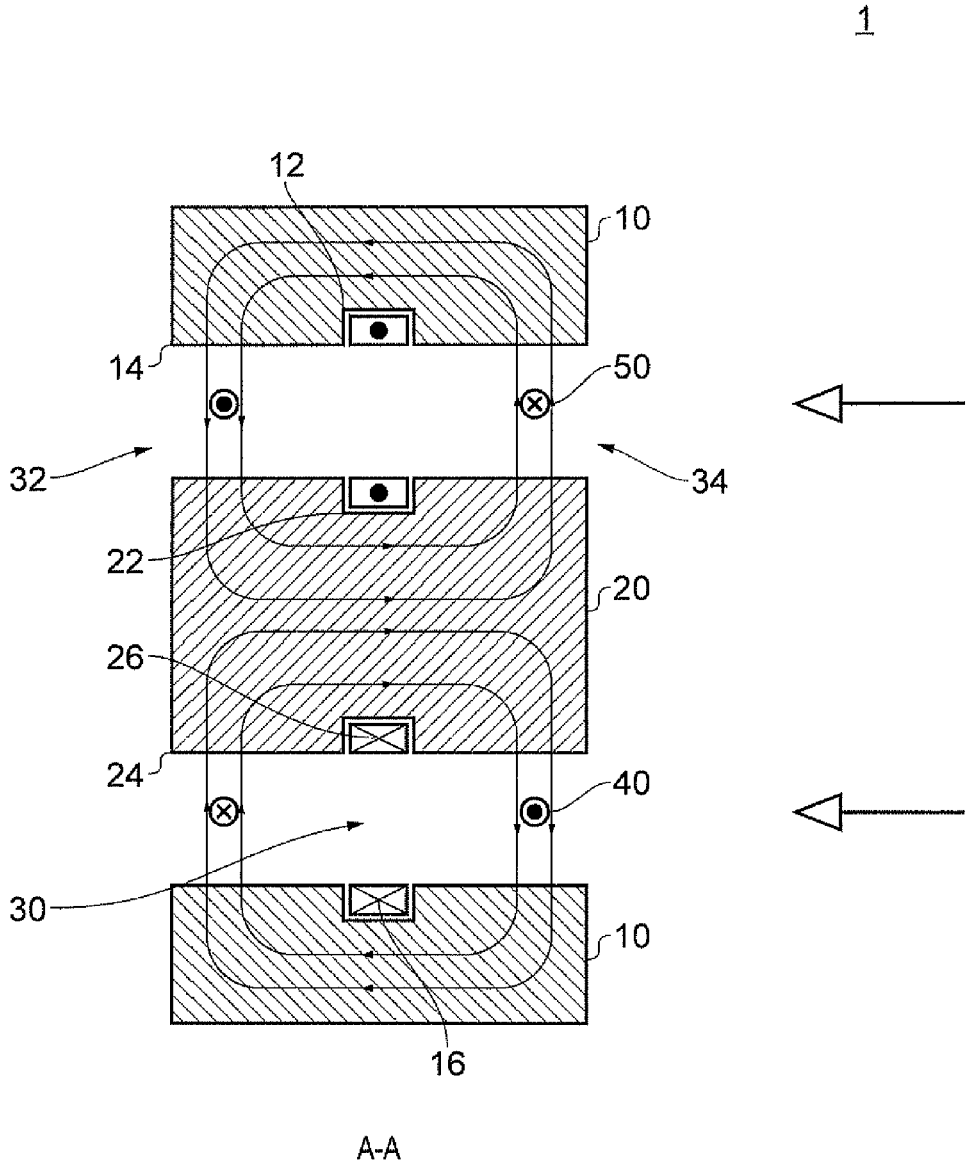
Figure 3:
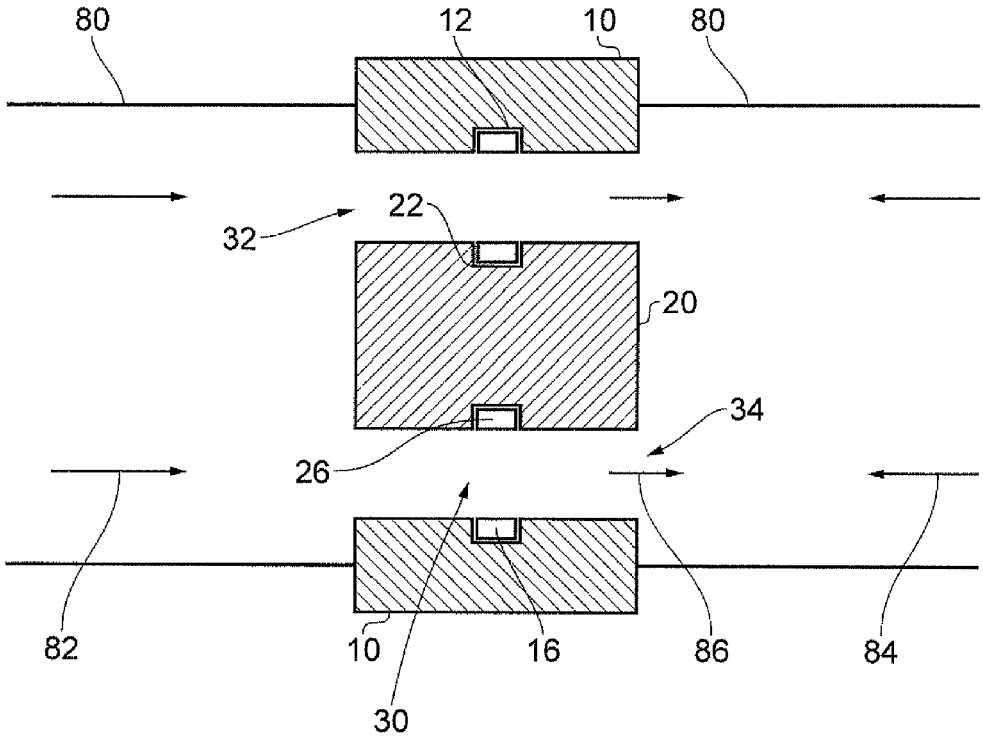
Figure 4:
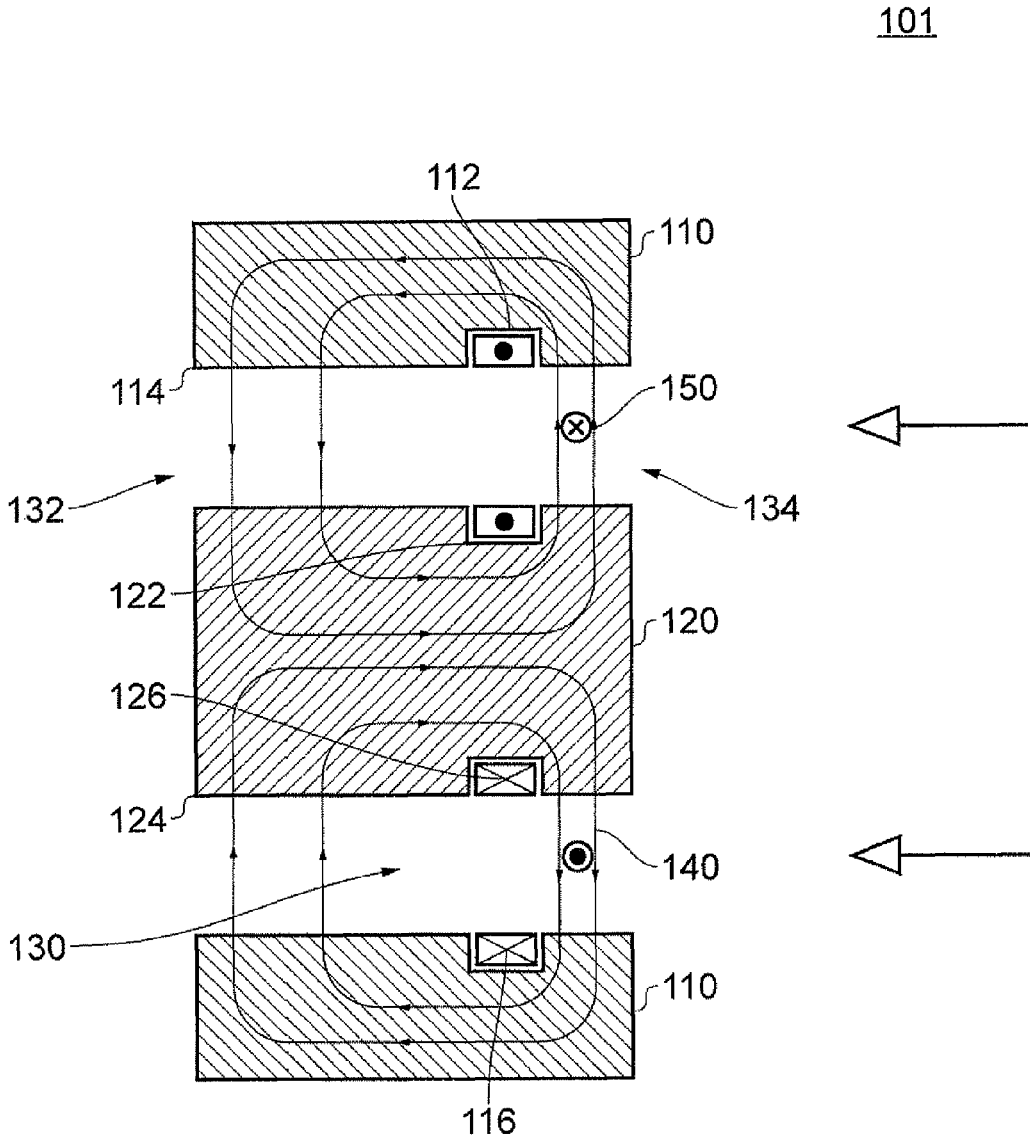
Figure 5:
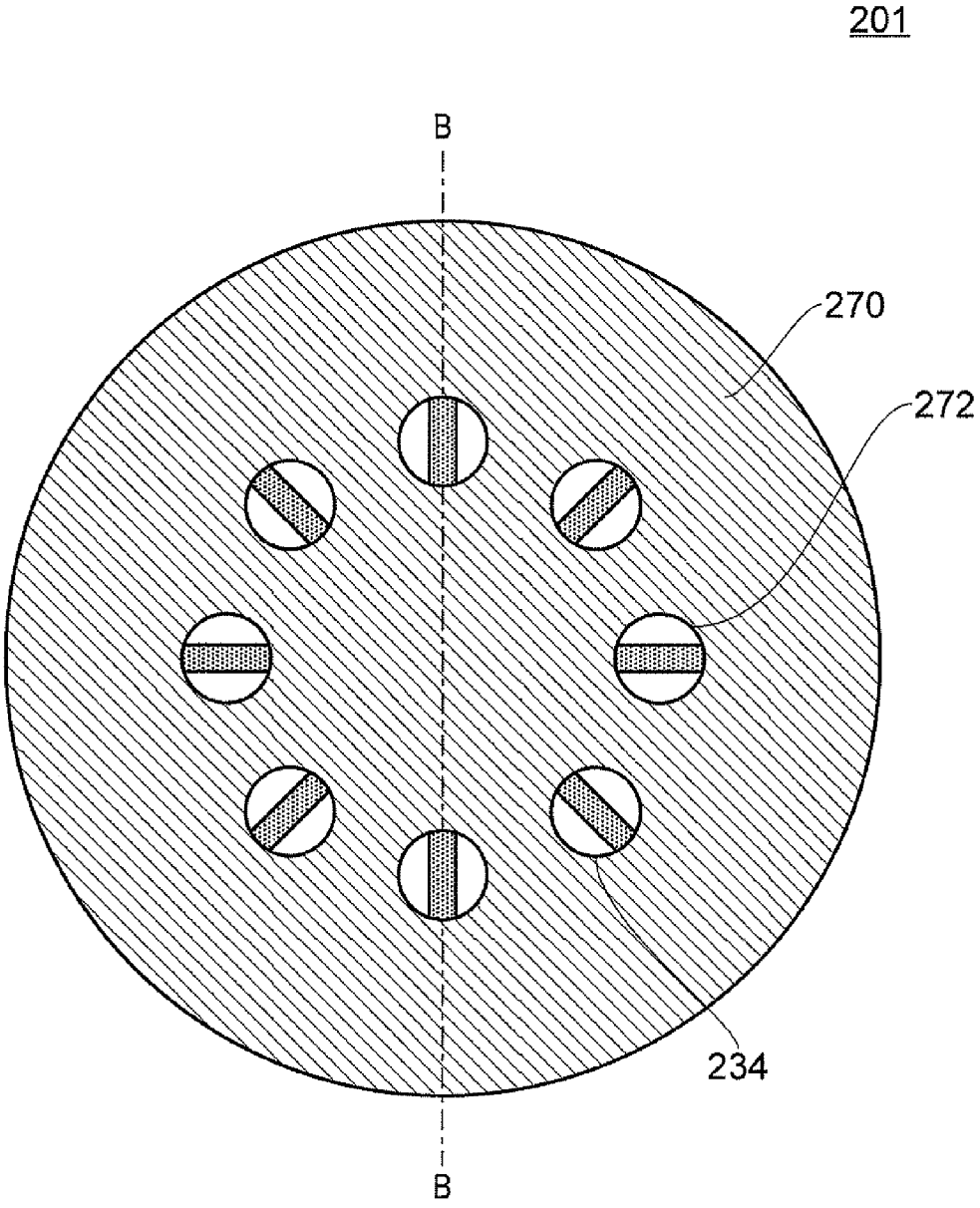
Figure 6:
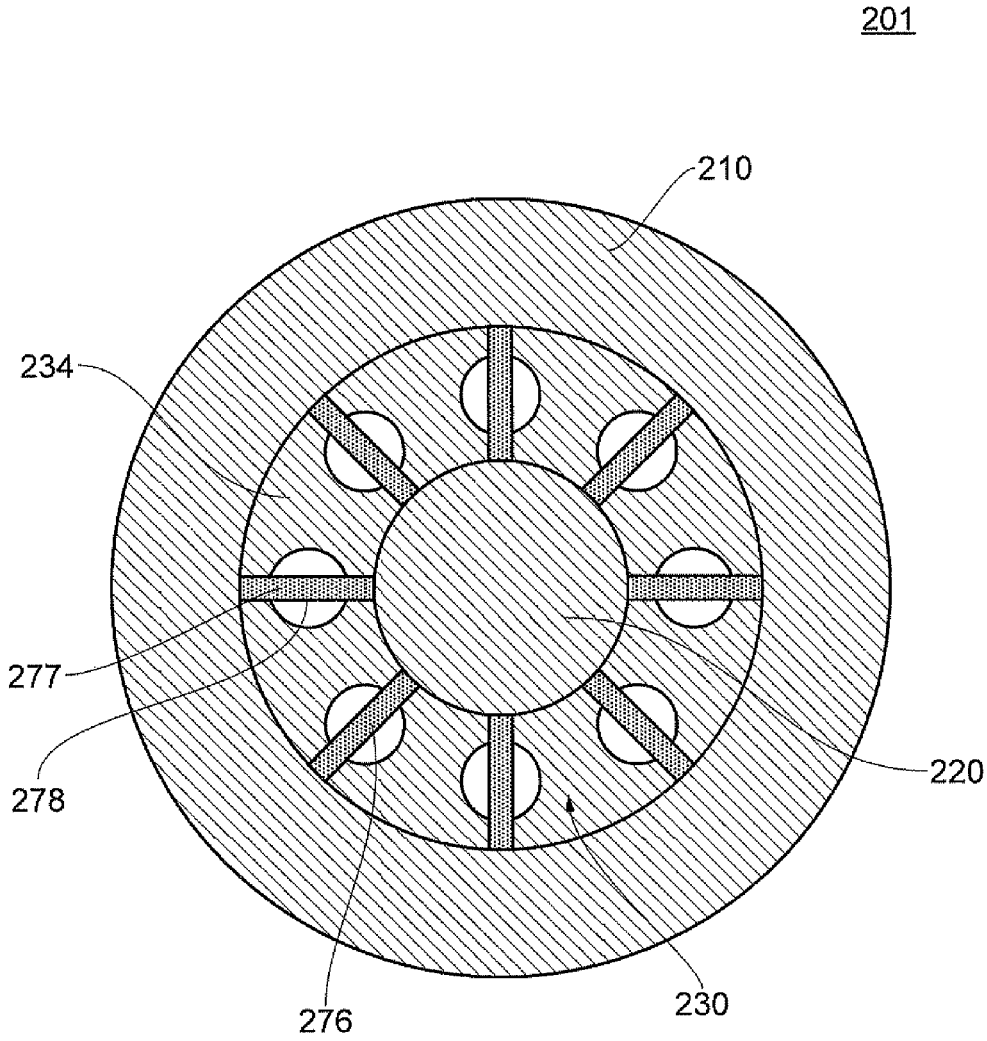
Figure 7:
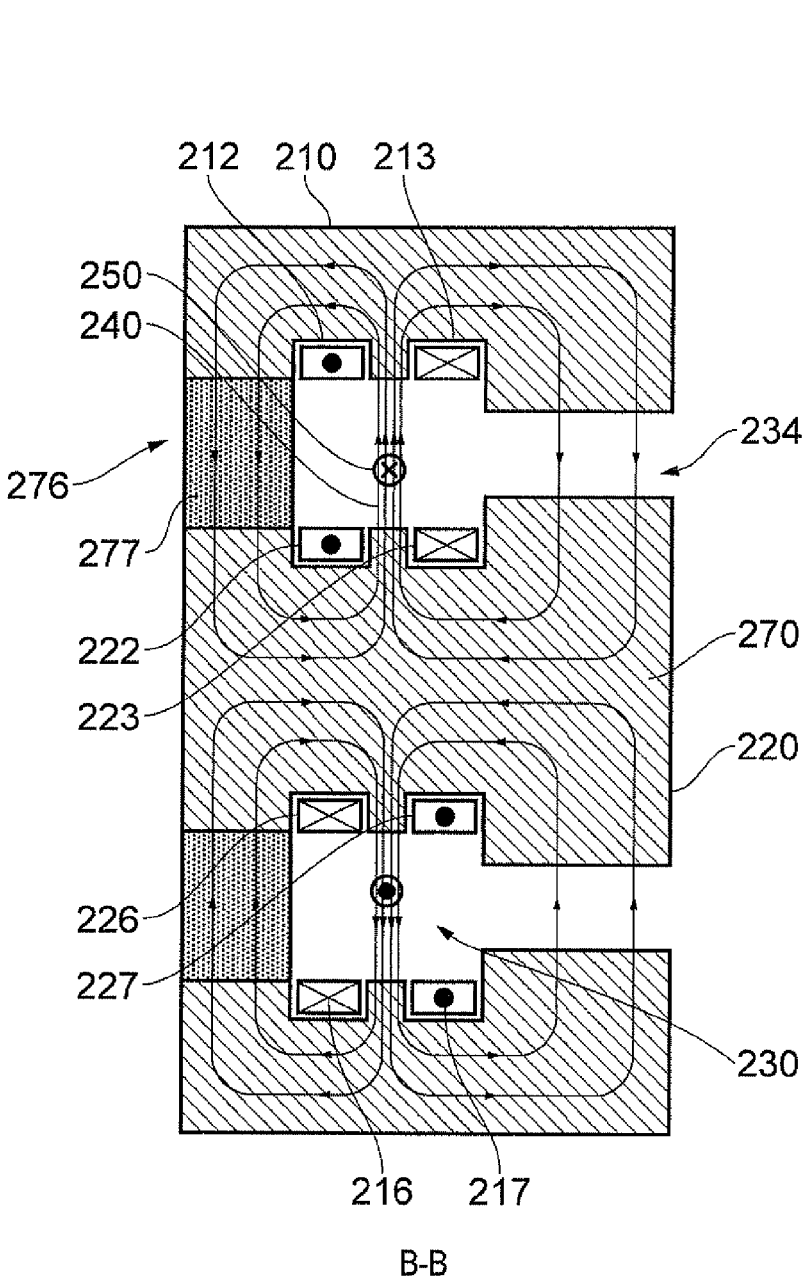

Embodiments of the present invention will now be described, by way of example only, with reference to the accompanying drawings, in which:

FIG. 1 schematically shows a flashback protector according to a first embodiment of the present invention;

FIG. 2 schematically shows the cross section A-A of FIG. 1;

FIG. 3 schematically shows the flashback protector of FIG. 1 positioned in a fuel-supply line;

FIG. 4 schematically shows a flashback protector according to a second embodiment of the present invention;

FIG. 5 schematically shows the upstream end view of a flashback protector according to a third embodiment of the present invention;

FIG. 6 schematically shows the downstream end view of a flashback protector according to a third embodiment of the present invention;

FIG. 7 schematically shows the cross section B-B of FIG. 6; and

Figure 8:
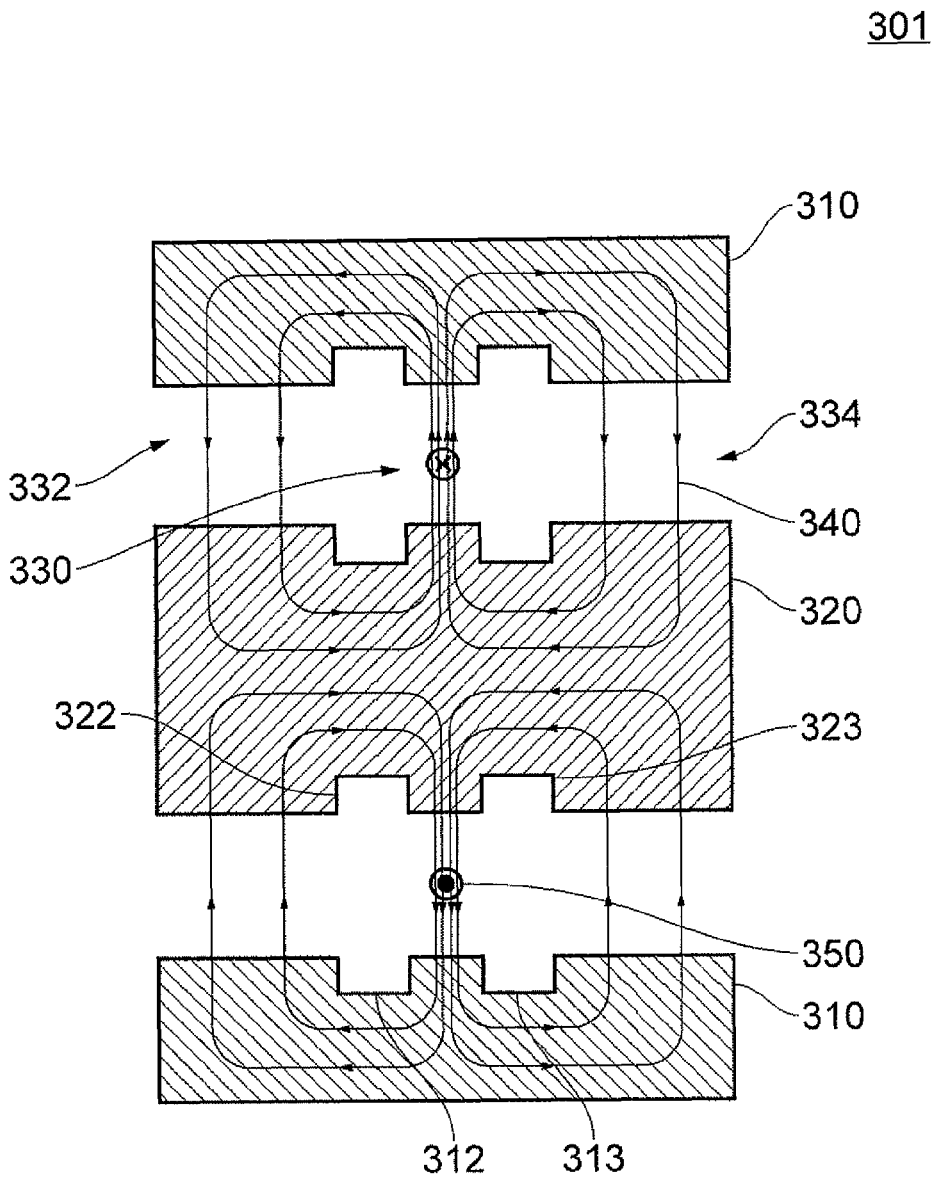

FIG. 8 schematically shows a flashback protector according to a fourth embodiment of the invention.

Figure 9:
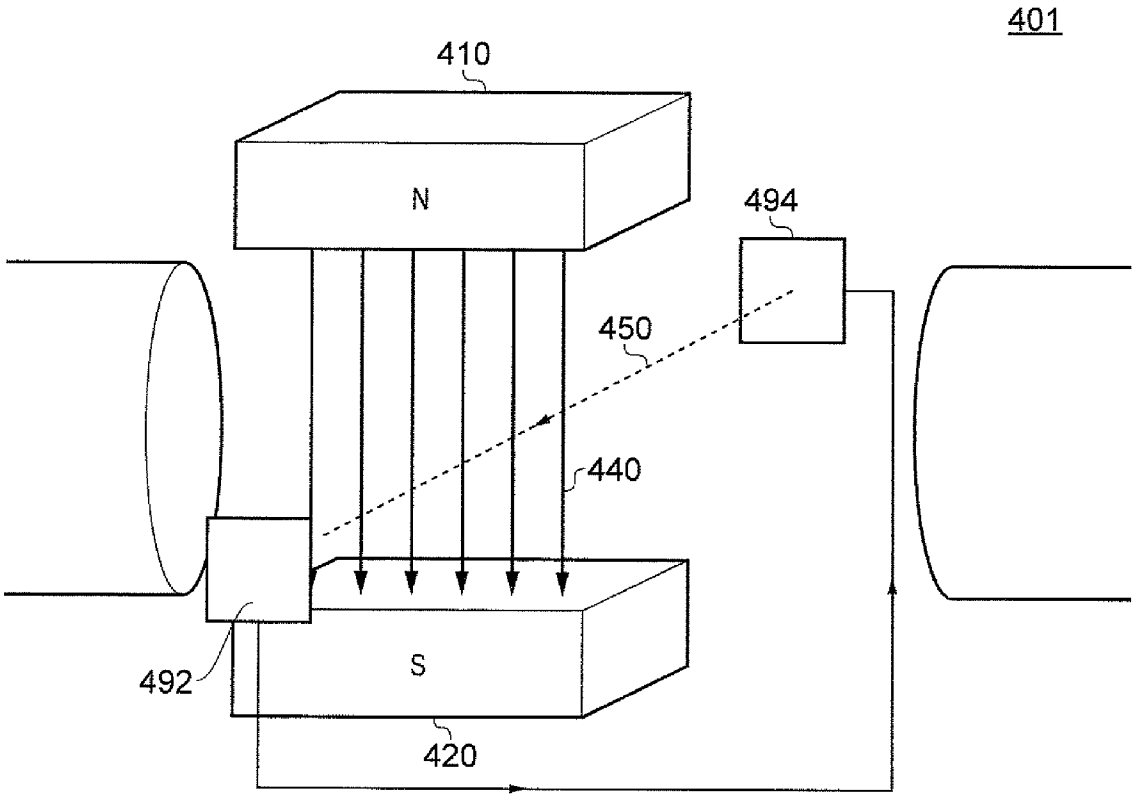

FIG. 9 schematically shows a flashback protector according to a fifth embodiment of the invention.

Figure 10:
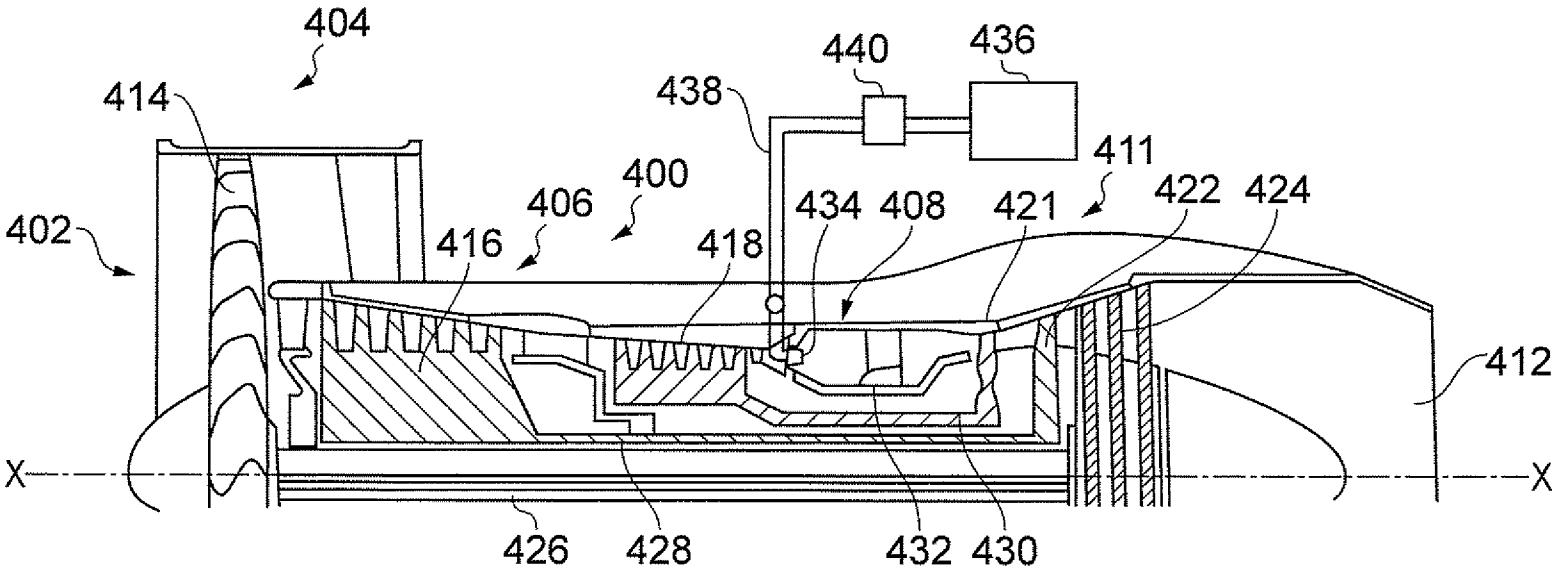

FIG. 10 schematically shows a turbofan gas turbine engine having a flashback protector according to the present invention.

FIG. 1 shows a downstream end view of a first embodiment of a flashback protector 1. The flashback protector 1 comprises a magnetic field generator comprising an outer annular pole piece 10 and an inner cylindrical pole piece 20. The outer and inner pole pieces 10, 20 are concentric with one another and an annular opening (or gap) 30 between them defines a flow path between an upstream side 32 and a downstream side 34.

Referring now to FIG. 2, the outer pole piece 10 comprises an annular recess 12 on an inner surface 14 and the inner pole piece 20 comprises an annular recess 22 on an outer surface 24. An outer winding 16 is located in the recess 12 of the outer pole piece 10 and an inner winding 26 is located in the recess 22 of the inner pole piece 20. The windings 16, 26 are connected to a controller (not shown) which supplies a flow of current to the windings 16, 26. This produces a radial magnetic field 40 between the pole pieces 10, 20. The direction of the magnetic field 40 depends on the direction of the flow of current in the windings 16, 26.

The pole pieces 10, 20 may be made of any suitable material such as a low-loss magnetic material. Examples include laminated electric steels and high-resistivity magnetic materials such as ferrite. Spacers, struts or supports (not shown) may be provided in the gap between the inner pole piece 20 and the outer pole piece 10 in order to maintain the relative positions of the inner and outer pole pieces. The spacers, struts or supports may carry electrical connections to the windings 16, 26.

As shown in FIG. 3, in use the flashback protector 1 is positioned in a fuel-supply line 80 between a fuel tank and a region of combustion in a combustion chamber. The fuel-supply line 80 supplies combustible fluid flowing in a first direction 82 away from the fuel tank and in normal use the combustible fluid flows through the annular opening 30 of the flashback protector 1.

When a flashback occurs, a flame travels from the combustion chamber down the fuel-supply line 80 towards the fuel tank in a second direction 84 opposite to the first direction 82. The flashback causes a mixture of gases comprising combustible fluid and products of combustion to be forced down the supply line 80 towards the fuel tank. The flame is considered to be a region where combustion of the combustible fluid occurs and can therefore be considered to be a flow of combusting fluid.

In essence, the flashback causes combustible, combusting and combusted fluid to flow towards the fuel tank in the second direction. The term 'flashback fluid' will be used to refer to a fluid flow towards the fuel tank that results from a flashback. As a result of the heat generated by combustion, the flashback fluid undergoes thermal ionization. This means that the flashback fluid is capable of conducting current.

When the flashback fluid reaches the flashback protector it flows through the annular opening 30 from the downstream side 34. With reference to FIGS. 1 and 2 the annular flow of flashback fluid interacts with the radial magnetic field 40 generated between the windings 16, 26 of the outer and inner pole pieces 10, 20 as follows.

The flashback fluid flows perpendicularly through the magnetic field 40 in the annular gap 30. Since the flashback fluid is an ionized gas, a current 50 is induced in the fluid in a direction mutually perpendicular to the flow direction 84 (which is towards the fuel tank). As shown in FIG. 1, this results in an annular electric current 50 flowing in the annular flow of fluid. In this embodiment two annular currents 50, 52 are induced in the fluid, one at the downstream end 34 and one at the upstream end 32 of the flashback protector 1. Since the direction of the magnetic fields are opposite at the downstream and upstream ends 32, 34, the annular currents 50, 52 flow in opposite directions.

The annular current flows 50, 52 interact with the magnetic field to produce a Lorentz force on the flashback fluid. This force is perpendicular to the current flow 50 and to the magnetic field 40 and is in a direction away from the fuel tank. This Lorentz force 86 prevents the flashback from propagating towards the fuel tank and hence prevents an explosion from occurring.

The flashback protector 1 has a relatively large flow path through it created by the annular opening 30. The fuel flow through the protector is therefore not significantly impeded. Further, the size of the flow path means that the flashback protector is less vulnerable to clogging when compared to those of the prior art. Additionally, because no material is placed in the way of the fuel flow path the flashback protector 1 is more tolerant of high-temperature flashbacks.

The magnitude of the Lorentz force can be altered by changing the strength of the magnetic field 40 in the annular opening 30. This can be done by changing the current supplied to the windings 16, 26.

In order to simplify the electrical connections, electrical winding 26 may be omitted. This would overcome the difficulty of supplying electrical power to windings on the inner pole piece 20 via electrical connections that would have to pass through the gap between the outer pole piece 10 and the inner pole piece 20. The magnetic field between the outer pole piece 10 and the inner pole piece 20 would then rely upon the electrical winding 16 on the outer pole piece 10. Similarly, the electrical winding 16 on the outer pole piece 10 may be omitted if required. The magnetic field between the pole pieces 10, 20 would then rely upon the winding 26 on the inner pole piece 20.

In order to improve the electrical conductivity of the flashback fluid the combustible fluid may be seeded with easily ionisable materials such as alkali or alkaline-earth metals or their compounds.

The performance of the flashback protector 1 can also be improved by further ionisation of the flame, for example. This may be done by irradiating the flame with electromagnetic radiation such as microwaves, ultraviolet, X-rays or gamma rays, for example, or with corpuscular radiation such as alpha rays, beta rays, or beams of ions, for example. The flame may also be seeded with chemicals such as alkali metals or their compounds or with radioactive substances.

FIG. 4 shows a second embodiment of a flashback protector 101 in which only one annular current 150 is induced in the flame in the region of the downstream side 134. This is done by positioning the windings 116, 126 on the outer and inner pole pieces 110, 120 closer to the downstream side 134 than the upstream side 132. This means that the magnetic field 140 is stronger at the downstream side 134 and therefore an annular current 150 is induced in the fluid in this region. This means that a stronger Lorentz force is applied to the flashback as it enters the flashback protector 101.

FIGS. 5, 6 and 7 show a third embodiment of a flashback protector 201. As shown in FIG. 5, the downstream end 234 has an end cap 270 that has holes 272 in it that allow the passage of fluid through the opening 230. The end cap 270 is integrally formed with the outer and inner pole pieces 210, 220. As shown in FIG. 6, the upstream end 232 has an arrangement of spokes 276 that bridge the gap between the outer and inner pole pieces 210, 220. Each spoke 276 comprises a ferromagnetic core 277 and an insulating refractory coating 278. The end cap 270 and the spokes 276 allow magnetic flux to pass more easily between the outer and inner pole piece 210, 220.

Referring now to FIG. 7, the outer pole piece 210 has two annular recesses 212, 213 and the inner pole piece 220 has two annular recesses 222, 223. First and second outer windings 216, 217 are located in the recesses 212, 213 of the outer pole piece 210 and first and second inner windings 226, 227 are located in the recesses 222, 223 of the inner pole piece 220. Current is supplied to the first outer winding 216 and the first inner winding 226 in the same direction, and an opposite flow of current is supplied to the second outer winding 217 and the second inner winding 227. This produces a concentrated magnetic field 240 in a region between the first and second recesses. In use, an annular current 250 is therefore induced in the flashback fluid in this region, thus generating a Lorentz force on the fluid in a direction away from the fuel tank. This force acts to stop the propagation of the flashback towards the fuel tank.

In FIGS. 5, 6 and 7, the embodiments may be simplified by omitting the electrical windings on the inner pole pieces and relying on the electrical windings on the outer pole pieces to generate the magnetic field between the pole pieces.

Alternatively, the embodiments may be simplified by omitting the electrical windings on the outer pole pieces and relying on the electrical windings on the inner pole piece to generate the magnetic field between the pole pieces.

FIG. 8 shows a fourth embodiment of a flashback protector 301. In this embodiment the pole pieces 310, 320 are made of a permanent magnetic material. This generates a radial magnetic field 340 in the annular opening 330 between the inner and outer pole pieces 310, 320. When a flashback occurs an annular current 350 is generated in the flashback fluid in the same way as for the other embodiments. This causes a Lorentz force to be generated on the flashback fluid which prevents or limits the propagation of the flashback towards the fuel tank. The main advantage to using magnetic pole pieces without windings is that the flashback protector requires no maintenance.

The high-temperatures that the flashback protector 1 is exposed to during use may adversely affect its performance. One way of preventing the pole piece 10, 20 from overheating is to provide them with cooling ducts. These cooling ducts can then be supplied with a cooling fluid, such as air, which acts to cool the pole pieces. There are a number of other ways of mitigating overheating. These include: coating the surfaces with refractory materials such as thermal barrier coatings, using high-temperature insulation in the electrical windings such as glass fibre, applying similar techniques to those used in fire-resistance cables to protect the electrical windings, using high-temperature conductors such as tungsten for the windings.

It is not essential that the flow path defined by the opening 30 is annular. In other embodiments the flow path in a plane perpendicular to the flow direction may be a closed loop of any shape such that current can flow entirely in the flame.

However, with reference to FIG. 9, in yet a further embodiment the flashback fluid does not flow in a closed loop through the flashback protector. Instead, electrodes 492, 494 are provided that allow the flow of current 450 through the fluid. However, the basic principle is the same. The flashback fluid flows towards the fuel tank through a magnetic field 440 generated by two permanent magnets 410, 420. This induces a current 450 in the fluid which flows through the fluid between the two electrodes 492, 494. The current 450 induced in the fluid interacts with the magnetic field 440 to generate a Lorentz force on the fluid that is in a direction away from the fuel supply. This prevents or limits the propagation of the flashback towards the fuel tank.

FIG. 10 shows a turbofan gas turbine engine 400 comprising in flow series an intake 402, a fan section 404, a compressor section 406, a combustion section 408, a turbine section 410 and an exhaust 412. The fan section 402 comprises a fan 414. The compressor section 404 comprises an intermediate pressure compressor 416 and a high pressure compressor 418. The turbine section 410 comprises a high pressure turbine 420, an intermediate pressure turbine 422 and a low pressure turbine 424. The low pressure turbine 424 is arranged to drive the fan 414 via a first shaft 426. The intermediate pressure turbine 422 is arranged to drive the intermediate pressure compressor 416 via a second shaft 428 and the high pressure turbine 420 is arranged to drive the high pressure compressor 418 via a third shaft 430. The combustion section 408 comprises an annular combustion chamber 432 and a plurality of fuel injectors 434 are arranged to supply fuel into the annular combustion chamber 432. A fuel supply, fuel tank, 436 is arranged to supply fuel to the fuel injectors 434 via a fuel pipe 438 and the fuel pipe 438 has a flashback protector 440 is positioned between the fuel injectors 434 of the annular combustion chamber 432 and the fuel supply 436.

The flashback protector is particularly suitable for use in gas turbine aero engines but may be used in any situation where flashback protection is required. Examples include petrochemical and gas installations, appliances or pipelines, fuel cells, welding apparatus or any other application where a flammable or explosive gas is used.

The invention claimed is:

1. A flashback protector for limiting the propagation of a flame towards a fuel supply, the flashback protector comprising:

a downstream side and an upstream side defining a flow path between them, a magnetic-field generator arranged to generate a magnetic field across the flow path, the magnetic-field generator comprises a first pole piece having a cavity within which a second pole piece is located in such a way that an opening is formed between the first and second pole pieces which in use provides the flow path for the fluid and across which the magnetic field is generated, wherein when in use and a flashback occurs fluid flows in the flow path towards the fuel supply through the magnetic field, which then induces a flow of current in the fluid, thereby generating a force on the fluid in a direction away from the fuel supply, wherein the flow path is in the form of a closed loop in a plane perpendicular to the flow direction such that in use the induced current can flow entirely within the fluid.

2. A flashback protector according to claim 1, wherein the first pole piece is generally annular and the second pole piece is generally cylindrical, the first and second pole pieces being concentric, so that the flow path is annular in a plane perpendicular to the flow direction.

3. A flashback protector according to claim 1, wherein the magnetic-field generator comprises first and second electromagnets, each including a pole piece and a winding.

4. A flashback protector according to claim 1, wherein the magnetic-field generator comprises first and second permanent magnets.

5. A flashback protector according to any claim 1, wherein the magnetic-field generator is arranged to generate a magnetic field that is stronger at the downstream side than the upstream side.

6. A flashback protector according to claim 1, wherein the flashback protector is positioned in a fuel supply line between a fuel supply and a combustion chamber.

7. A gas turbine engine comprising a flashback protector according to claim 1.

8. A method of limiting the propagation of a flame towards a fuel supply, comprising:

providing a magnetic-field generator comprising a first pole piece having a cavity within which a second pole piece is located in such a way that an opening is formed between the first and second pole pieces which in use provides a flow path for a fluid and across which a magnetic field is generated, generating the magnetic field across the flow path defined between a downstream side and an upstream side, such that when a flashback occurs fluid flows towards the fuel supply through the magnetic field, which then induces a flow of current in the fluid, thereby generating a force on the fluid in a direction away from the fuel supply, wherein the fluid flows in a closed loop in a plane perpendicular to the flow direction and in use the induced current flows entirely within the fluid.

9. A method according to claim 8, wherein the closed loop is generally annular.

10. A method according to claim 8, wherein the magnetic field is generated by electromagnets.

11. A method according to claim 8, wherein the magnetic field is generated by permanent magnets.

12. A method according to claim 8, wherein the magnetic field is stronger at the downstream side than the upstream side.

13. A method according to claim 8, wherein the flashback flows through the flow path towards the fuel supply from a combustion chamber.

* * * * *